United States Patent [19]

Dutcher

[11] 4,199,063

[45] * Apr. 22, 1980

[54] RECLOSEABLE DISPENSING CARTON AND BLANK THEREFOR

[75] Inventor: Daniel P. Dutcher, Woodbury, Minn.

[73] Assignee: Champion International Corporation, Stamford, Conn.

[ * ] Notice: The portion of the term of this patent subsequent to Mar. 25, 1997, has been disclaimed.

[21] Appl. No.: 916,702

[22] Filed: Jun. 19, 1978

[51] Int. Cl.[2] ..... B65D 5/72

[52] U.S. Cl. ..... 206/626; 229/17 B; 229/38

[58] Field of Search ..... 206/626, 621, 629; 229/17 B, 17 R, 38, 39 R, 44 R

[56] References Cited

U.S. PATENT DOCUMENTS

| | | | |
|---|---|---|---|
| 340,904 | 4/1886 | Auchterlonie | 229/17 B |
| 2,789,746 | 4/1957 | Hovland | 206/621 |
| 3,059,827 | 10/1962 | Pellaton et al. | 229/17 R |
| 3,153,504 | 10/1964 | Mischel et al. | 229/17 R |
| 3,423,005 | 1/1969 | Leibson et al. | 229/44 R |
| 3,595,466 | 7/1971 | Rosenburg, Jr. | 206/626 |

*Primary Examiner*—Stephen P. Garbe
*Attorney, Agent, or Firm*—Evelyn M. Sommer

[57] ABSTRACT

A dispensing carton, particularly adapted for use with small objects, such as candies, pills, etc., is formed of a tubular structure which is closed at one end, while the other end includes two overlapping end closures. The lowermost closure is fixed and includes an aperture of a sufficient size to enable an object to readily pass therethrough, while the outer overlapping closure tab is pivotally connected along one side of the carton, and includes end flaps which limit the degree of pivoting of the closure tab. The latter may be reinforced with a glue flap, and the recloseable dispensing carton is formed from a single sheet of a carton blank.

10 Claims, 5 Drawing Figures

RECLOSEABLE DISPENSING CARTON AND BLANK THEREFOR

The subject invention relates to a new and improved recloseable dispensing carton, and a carton blank for forming the dispensing carton. More particularly, the subject invention relates to a carton blank and a dispensing carton wherein one end of the carton includes an overlapping arrangement of closure tabs, the lowermost tab being fixed and having an opening therein. The uppermost tab is pivotally connected to one side of the carton and may be rotated to a position to close the end of the carton, or to an angled, open position wherein objects may be dispensed from the carton. In order to limit the degree of pivoting of the uppermost closure tab, the latter includes end flaps which are configured so as to cooperate with the interior structure of the carton for limiting the pivotal movement of the outermost closure tab.

The recloseable carton of the subject invention is of an elongated tubular enclosure configuration, having first and second sides, and first and second edges. The bottom end of the carton is permanently closed, while the opposite end is recloseable by an overlapping relationship of a lowermost elongated tab and a pivoted closure tab. The lowermost elongated tab includes an aperture disposed intermediate the length of said tab and of slightly greater size than objects packaged within the carton to allow dispensing of such objects from the carton. The lowermost elongated tab preferably includes opposed end flaps which are hingedly connected thereto, and which are wholly disposed within the carton, respectively along the first and second edges of the carton. The uppermost closure tab is hingedly connected to the second side of the carton and overlaps the lowermost elongated tab. The closure tab includes opposed end stop flaps, each of which is of greater length than the width of the first and second sides of the carton. Also, each end stop flap includes an angled edge portion which, upon pivoting of the closure tab to the open position of the carton, contacts the inside surface of the first side of the carton, thereby limiting the extent of pivoting of the closure tab. Preferably, the closure tab is designed to rotate between 40° and 60°, and preferably at an angle of 45°, relative to the plane of the elongated tab. The recloseable carton of the subject invention is preferably formed of a single sheet of carton blank material, and the closure tab may be reinforced by a glue flap. In addition, the opposite edges of the carton may be formed by overlapping panels which are bonded together for providing additional structural rigidity to the length of the tubular carton.

With the foregoing and other features and objects in view, the subject invention will be described in detail with reference to the accompanying drawing in which.

Figure 1:
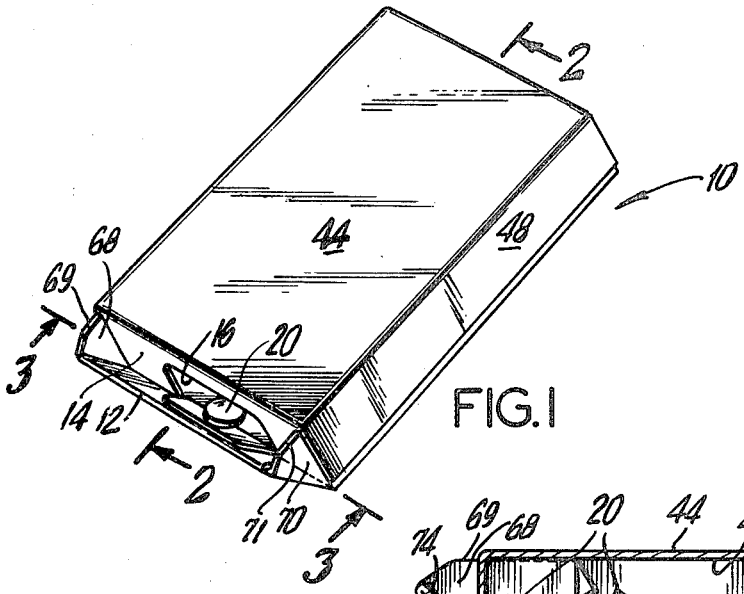
FIG. 1 is a perspective view of the subject dispensing carton in the open condition.
Figure 2:
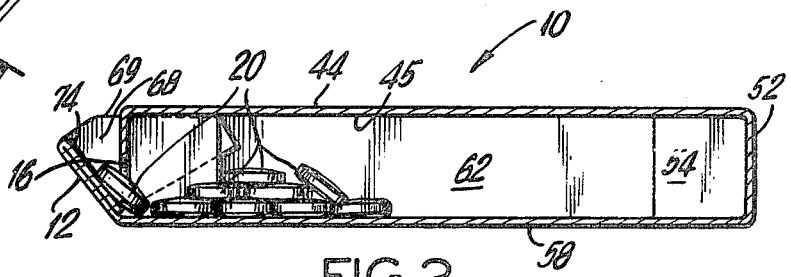
FIG. 2 is a cross-sectional view taken along line 2—2 of FIG. 1.
Figure 4:
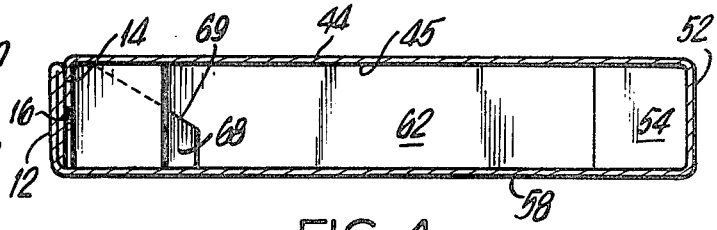
FIG. 4 is a cross sectional view similar to FIG. 2 but illustrating the dispensing carton in the closed condition.
Figure 5:
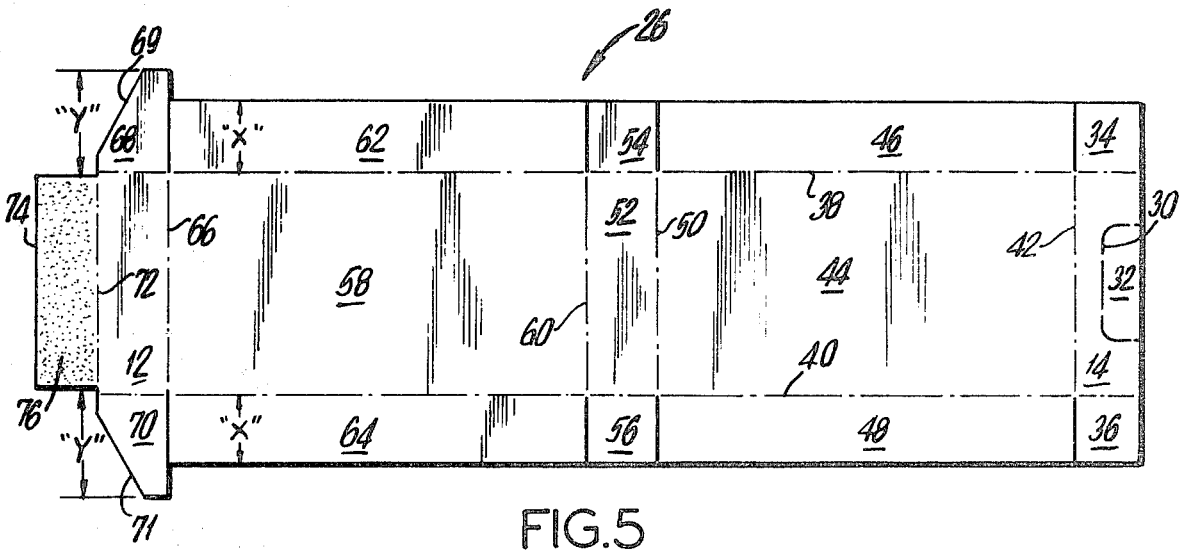
FIG. 5 is a plan view of the subject carton blank.

As illustrated in FIG. 1, the recloseable dispensing carton of the subject invention is of elongated tubular configuration, having a generally rectangular cross-section, and including a closed bottom, and a top portion that may be partially open for dispensing the contents of the carton, and reclosed for storage purposes. The dispensing carton is generally designated in FIG. 1 by the numeral 10, and is formed of a single sheet of a carton blank, as shown in FIG. 5. In its fully erected condition, carton 10 is closed at its bottom end, while the upper end thereof includes a recloseable opening, with the opening being covered by a pivotally mounted closure tab 12 which, when in the extended position shown in FIGS. 1 and 2, uncovers opening or aperture 16 in elongated tab 14 to enable the contents 20 within the carton to be dispensed. As shown in FIGS. 1 and 2, the contents 20 are in the form of pills, however, other small objects, such as candy, etc. may also be packaged in the carton 10. As illustrated in FIG. 4, when the closure tab 12 is rotated to its retracted position, the opening 16 is closed.

Referring to FIG. 5, the carton blank 26 for forming the dispensing carton of the subject invention includes, starting from the right side of FIG. 5, the elongated tab 14 which is perforated as at 30 for removal of panel 32 to define the aperture 16 (see FIG. 1). End flaps 34 and 36 are respectively hingedly connected to the elongated tab 14 along hinge lines 38 and 40. Hingedly connected along hinge line 42 to the elongated tab 14 is a first side panel 44 having first edge 46 and second edge 48 hingedly connected thereto along hinge lines 38 and 40, respectively. First and second edges 46 and 48 form a first pair of edges for the erected carton, as more fully described hereinafter.

Hingedly connected along hinge line 50 to the first side panel 44 is bottom panel 52 which, in turn, has hingedly connected thereto along hinge lines 38 and 40 bottom end flaps 54 and 56. A second side panel 58 is hingedly connected to the bottom panel 52 along hinge line 60. A second pair of first and second edges, designated 62 and 64 are hingedly connected to the second side panel 58 along hinge lines 38 and 40.

Figure 3:
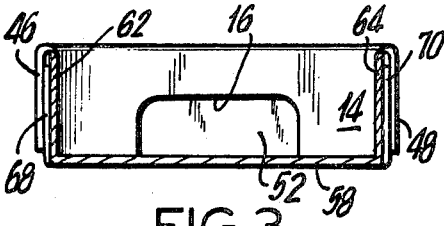
FIG. 3 is an elevational view taken along line 3—3 of FIG. 1.

As will be noted in FIG. 5, the width or height of the end flaps 34, 36, 54, 56 and edges 46, 48 and 62, 64 are equal, and are designated by the letter "X". In the erected condition of the carton, by this arrangement, the first and second pairs of first and second edges 46-48 and 62-64 are arranged in overlapping relationship, and are bonded together to provide longitudinal structural reinforcement for the tubular carton 10, as illustrated in FIGS. 1 and 3.

Turning again to FIG. 5, hingedly connected to the second side panel 58 along hinge line 66 is the pivotally mounted closure tab 12. Hingedly connected to the opposite ends of the closure tab 12 along hinge lines 38 and 40 are stop flaps 68 and 70. As illustrated in FIG. 5, the length of each stop flap 68 and 70 is designated by the letter "Y", and is greater than the dimension "X" of the side edges 46-48, 62-64, bottom flaps 54-56, and end flaps 34-36. In addition, whereas all of the latter are generally rectangular in configuration, the stop flaps 68 and 70 are in the form of irregular pentagons, including angled surfaces 69 and 71, respectively. In order to reinforce the closure tab 12, a glue flap 74 may be pivotally connected along hinge line 72 to the closure tab 12, with adhesive 76 being applied to the inside surface thereof.

In the erection and assembly of the dispensable carton 10, the several panels of the carbon blank 30 are folded about hinge lines 38 and 40, and the vertical hinge lines, whereby the bottom flaps 54 and 56 are wholly disposed within the carton 10, and the first and second pairs of edges 46-48 and 62-64 are bonded together to form the tubular structure of the carton. The elongated tab 14 is folded about the hinge line 42, with the end flaps 34 and 36 being wholly disposed within the carton and contiguous to the opposite edges of the carton. The end stop flaps 68 and 70 are also disposed within the tubular carton and are slidably received between the respective edge of the carton and the end flaps 34 and 36 of the elongated tab 14. The glue flap 74 is adhesively bonded to the inside surface of the closure tab 12.

As shown in FIG. 4, in the closed condition of the carton, the angled edge 69 of the end stop flap 68 is disposed at an angle to the inside surface 45 of the first side 44 of the carton. In this condition, the closure tab 12 is in the fully retracted position thereby closing off the aperture 16 in the elongated tab 14, thus enclosing the contents 20 within the carton 10.

In the dispensing condition, the closure tab 12 is rotated relative to the plane of the elongated tab 14 until the angled edge 69 of the end stop flap 68 engages the inside surface 45 of the first side panel 44. Preferably, the end stop flaps 68 and 70 are configured so as to limit the angular rotation of the closure tab 12 relative to the elongated tab 14 to between 40° and 60°, and preferably at an angle of 45°. As shown in FIG. 1, the panel portion 32 of the elongated tab 14 may be initially bonded to the undersurface of the closure tab 12, thereby providing a sealed carton 10, until such time as the closure tab 12 is rotated to the open position, thereby creating the opening 16 by rupture of the perforation line 30.

Accordingly, there is provided a new and improved dispensing carton including recloseable end means, as well as a carton blank for forming the dispensing carton. The carton is of generally tubular configuration, including reinforced first and second side edges, as well as a recloseable closure tab including unitary means for limiting the extent of opening thereof. Still further, means are provided in the form of the glue tab 74 for structurally reinforcing the closure tab, and the carton blank may be formed with a perforated panel portion 32 which may be initially bonded to the closure tab 12 such that the carton may be shipped in a condition such that the closure tab may not be rotated to its open position unless the perforation 34 is torn. In other words, dispensing carton 10 may be shipped in a sealed condition, and after the initial opening thereof by pivoting of the closure tab 12, may be reclosed for storage of the contents within the carton 10. The latter is formed of a single carton blank, and may be readily erected on conventional automatic erection equipment, thereby resulting in an inexpensive-to-manufacture carton, having integral recloseable means.

This invention is not limited to the particular details of construction and embodiments illustrated and described hereinabove, as many equivalents will suggest themselves to those skilled in the art. It is accordingly desired that the appended claims be given a broad interpretation commensurate with the scope of the invention within the art.

What is claimed is:

1. A recloseable carton for dispensing small objects comprising an elongated tubular enclosure including first and second sides, and first and second edge flaps; said enclosure being closed at one end while the other end is recloseable by, in turn, and in overlapping relationship, a lowermost elongated tab extending from said first side and including an aperture therein, said aperture disposed intermediate the length of said lowermost elongated tab and being slightly greater in size than the objects so as to allow the latter to pass therethrough, said lowermost elongated tab including opposed end flaps hingedly connected thereto and disposed wholly within said carton respectively along said first and second edge flaps; and a closure tap hingedly connected to the second side and overlapping said lowermost elongated tab, said closure tab including opposed end stop flaps which are respectively disposed between said end flaps and the first and second edge flaps, each stop flap being of greater length than the width of the contiguous edge flaps of the carton thereby limiting the extent of pivoting of the closure tab relative to the elongated tab during dispensing of objects from the recloseable carton.

2. A recloseable carton for dispensing small objects as in claim 1 wherein said carton is made of a single sheet of paperboard blank material.

3. A recloseable carton for dispensing small objects as in claim 1 wherein said closure includes a glue flap hingedly connected to the edge of the closure tab opposite its hinged edge connection to the second side; said glue flap being bonded to the inside surface of the closure tab.

4. A recloseable carton for dispensing small objects as in claim 1 wheren each said end stop flap includes an angled edge which, when the closure tab is in its fully open position, contacts the inside surface of the first side of the carton.

5. A recloseable carton for dispensing small objects as in claim 1 wherein said closure tab is pivotable in the range between 40°-60° relative to the plane of said elongated tab.

6. A recloseable carton for dispensing small objects as in claim 1 wherein said closure tab rotates 45° relative to the plane of said elongated tab.

7. A recloseable carton for dispensing small objects as in claim 1 wherein said side edge flap are formed of double thickness material for structurally reinforcing the recloseable carton.

8. A carton blank for a dispensing carton having a recloseable end formed by a pivoted closure tab overlapping an apertured elongated tab, said blank comprising, in turn:

an elongated tab perforated intermediate its length to define an aperture, said elongated tab including end flaps extending from the top and bottom thereof;

a first side panel hingedly connected to said elongated tab and including a first pair of first and second edge flaps extending from the top and bottom thereof;

a bottom panel hingedly connected to said first panel and including bottom end flaps extending from the top and bottom thereof;

a second side panel hingedly connected to said bottom panel and including a second pair of first and second edge flaps extending from the top and bottom thereof; and a closure tab hingedly connected to said second side panel and including end stop flaps extending from the top and bottom thereof, each stop flap being of greater height than said first and second pairs of first and second edge flaps, with each said end stop flap including an angled edge portion.

9. A carton blank as in claim 8, wherein the heights of the end flaps extending from said elongated tab, the first and second pairs of first and second edge flaps, and the bottom end flaps are equal.

10. A carton blank as in claim 8, further including a glue flap hingedly connected to said closure tab.

* * * * *